US006314618B1

(12) United States Patent
Mehner et al.

(10) Patent No.: US 6,314,618 B1
(45) Date of Patent: Nov. 13, 2001

(54) MOISTURE CONDITIONER FOR LINT COTTON

(75) Inventors: Martin L Mehner; Samuel G. Jackson, both of Lubbock, TX (US)

(73) Assignee: Jackson-Charter Limited Partnership, Lubbock, TX (US)

( * ) Notice: Subject to any disclaimer, the term of this patent is extended or adjusted under 35 U.S.C. 154(b) by 0 days.

(21) Appl. No.: 08/976,896

(22) Filed: Nov. 24, 1997

(51) Int. Cl.[7] ..... D01B 1/04; D01G 9/08

(52) U.S. Cl. ..... 19/48 R; 19/308

(58) Field of Search ..... 19/39, 48 R, 66 R, 19/66 CC, 308; 29/6.1, 432, 895.2; 492/28, 30, 31; 72/327, 325

(56) References Cited

U.S. PATENT DOCUMENTS

| | | | | |
|---|---|---|---|---|
| 39,767 | * | 9/1863 | Brown | 19/48 R |
| 138,191 | * | 4/1873 | Platt | 241/93 |
| 202,611 | * | 4/1878 | Washburne | 19/308 |
| 573,431 | * | 12/1896 | Langer | 241/93 |
| 762,497 | * | 6/1904 | Snyder | 241/93 |
| 1,376,704 | * | 5/1921 | Koinzer | 241/93 |
| 1,979,748 | * | 11/1934 | Kimmel | 72/327 |
| 2,450,915 | * | 10/1948 | Powell | 19/308 X |
| 2,670,019 | * | 2/1954 | Cuyler | 241/93 |
| 2,834,058 | | 5/1958 | Bryant . | |
| 3,038,212 | * | 6/1962 | Smith | 19/95 |
| 3,324,513 | | 6/1967 | Hurdt . | |
| 3,324,514 | * | 6/1967 | Creighton | 19/308 X |
| 3,905,570 | * | 9/1975 | Rowe, III | 18/308 X |
| 4,103,397 | | 8/1978 | Jackson . | |
| 4,140,503 | | 2/1979 | Vandergriff . | |
| 4,343,119 | * | 8/1982 | Bahnfleth | 72/327 X |
| 4,547,935 | * | 10/1985 | Jagst | 19/95 X |
| 5,381,587 | * | 1/1995 | Vandergriff | 19/66 CC X |
| 5,414,914 | * | 5/1995 | Suzuki et al. | 492/30 X |

FOREIGN PATENT DOCUMENTS

| | | | | |
|---|---|---|---|---|
| 711188 | * | 1/1980 | (RU) | 19/39 |

OTHER PUBLICATIONS

Lummus Condenser System advertisement; Lummus Corporation; no date.

The Vandergriff Moisture Restoration System advertisement; Consolidated; no date.

* cited by examiner

*Primary Examiner*—Ismael Izaguirre

(74) *Attorney, Agent, or Firm*—Bracewell & Patterson, L.L.P.

(57) ABSTRACT

An apparatus for processing a fibrous material batt like lint cotton to increase the moisture content of the material and to compress the batt of humidified fibers to increase the batt density. A stream of warm humid air is passed through the moving batt of fiber that is constrained between a rotatable hollow cylinder and a stationary perforated screen. The batt is doffed off the rotatable cylinder by a roller that serves to both doff and compress the batt. The doffer/compression roller compresses the batt against a smooth surface plate.

20 Claims, 3 Drawing Sheets

MOISTURE CONDITIONER FOR LINT COTTON

TECHNICAL FIELD

This invention relates in general to processing fibrous materials and in particular to a device for humidifying lint cotton and other fibrous materials and compressing the material to increase its density.

BACKGROUND ART

The desirability of humidifying or adding moisture to lint cotton in the cotton gin just before baling has been recognized for years. Although humidifying lint cotton increases the weight of the cotton, there are also many significant advantages to adding moisture at this stage of cotton processing. Adding moisture to lint cotton improves the capacity of the bale press whereas dry cotton requires higher compression forces and more time to charge and compact it into the press box. Dry cotton is also more difficult to press into a bale than cotton of normal moisture content. Higher press box compaction pressures require more bale press energy consumption, which causes wear and tear on the bale press components. Thus, humidified lint requires lower compaction pressures and reduces strain on the bale press components while creating bales that are within the acceptable weight range. Adding moisture to the fiber and compressing the batt before the press also enhances the press capacity since a denser volume of cotton is available for each charge of cotton delivered to the press box.

Older cotton presses use troublesome devices known as "dogs" to hold the compacted cotton in the press box while additional cotton is being added to form the bale. Modern high capacity, universal density presses do not use dogs. However, without dogs to hold the cotton in the box during bale formation, dry cotton springs out of the box requiring the tramper to work harder as it recompacts the cotton. In contrast, humidified lint stays in the box after compaction.

Bands consisting of wires or straps of steel are used to hold the formed bale together after the bale pressing operation. Dry cotton requires additional force to press it into a bale. The additional force causes excessive tension on the bands, thereby causing some of the bands to break during bale storage. Replacing broken bands is an expensive process for the warehouse. The rebanding process can also lead to contamination of the lint fiber which lowers the value of the cotton. Adding moisture to the cotton before the baling process reduces the occurrence of broken bands.

Several prior art methods have had limited success in humidifying lint cotton. Spraying the cotton batt with a fine mist of water to which a wetting agent had been added was probably the first systematic way used to apply moisture to lint cotton. This method was developed by the U.S. Government's Cotton Ginning Laboratory, at Stoneville, Miss., and was described by Charles A. Bennett in his article "Engineering Progress in Cotton Ginning" which appeared in the *Cotton Gin and Oil Mill Press* on Mar. 22, 1947. The apparatus employing this method is described in U.S. Pat. No. 3,324,513, issued Jun. 13, 1967, to D. B. Hurdt.

Exposing cotton to a stream of warm, humid air is the most popular method of humidifying cotton at the gin. Typically, the warm, humid air is generated by a device manufactured by Samuel Jackson, Inc., under the trademark HUMIDAIRE and controlled by the applicant herein. This device comprises an air heater in which a gas or oil-fired burner operates with an open flame in the stream of air to be humidified. The stream of air passes through an air washer chamber in which recirculated water spray scrubs the heated air, simultaneously cooling the air and evaporating the water. A supply of warm humid air is generated with an air temperature between 120 to 160 degrees F. dry-bulb temperature and 70 to 100% relative humidity.

The relative humidity of the air generated by the HUMIDAIRE device is regulated by independent control of the dry-bulb (air) and wet-bulb (water) temperatures. The closer these two temperatures are together, the higher the relative humidity. Regulating the burner fuel valve controls the dry-bulb temperature. Regulating the butterfly valve for throttling water flow to the spray nozzles in the air washer chamber controls the wet-bulb temperature.

At present, the most common lint cotton humidifier is the "Lint Slide Grid Humidifier," U.S. Pat. No. 4,103,397, issued Aug. 1, 1978, to S. G. Jackson. This device comprises a set of louver-like plates, or grids, forming the bottom surface of the lint slide between the battery condenser and press. Humid air is introduced in a plenum below the grids and passes up through the grids and through the cotton batt flowing downward to the press. Although this device offers a low cost solution, it is only capable of applying a limited amount of humid air to the cotton. The effectiveness of this device is limited since some of the air escapes around the cotton batt instead of penetrating it. In addition, this device is incapable of compressing the batt into a desirable denser mass.

An alternative location for applying humid air to the cotton batt is at the battery condenser of the gin. Humid air may be applied just before cotton reaches the doffing rollers of the screen drum of the battery condenser. For an example of this method, see U.S. Pat. No. 2,834,058, issued May 13, 1958, to W. R. Bryant. This humidification method has disadvantages. Since the humid air must pass through the screen drum of the condenser, moisture will often condense on the screen drum in cold weather, thereby causing the screen drum to "hair over" with cotton fibers that cannot be removed by the doffing rollers Air blockages result and the device soon chokes, resulting in downtime.

Before the introduction of the humidifier of U.S. Pat. No. 4,103,397, warm humid air was injected into the air and lint flowing to the battery condenser. A limited amount of lint humidification could be achieved this way. However, applying enough humid air to affect the moisture of the lint usually resulted in moisture condensing on the cold battery condenser screen, thus hairing the screen over as described before.

U.S. Pat. No. 4,140,503, issued Feb. 20, 1979, to A. L. Vandergriff, describes a method of applying dry, heated air to the condenser screen drum after the doffer rollers to attempt to dry the condensation off the screen. This patent also describes an arrangement of rollers for receiving the humidified cotton batt from the doffing rollers and compressing the cotton batt. The batt leaves the rollers and begins the descent down the slide to the press. Unfortunately, this device retains the inherent problem of moisture condensation on the screen and rollers since it applies moisture in the battery condenser.

DISCLOSURE OF THE INVENTION

An apparatus for humidifying lint cotton increases the moisture level of the cotton and the cotton batt density through compression. Cotton enters the apparatus after leaving the battery condenser and is conveyed between a perforated stationary screen and a rotatable hollow cylinder with a perforated metal surface. Warm humid air is pushed through the stationary screen, cotton batt and the cylinder to humidify the cotton batt. A roller doffs the cotton batt from the surface of the rotating cylinder and compresses the cotton against a smooth plate before the cotton batt exits the apparatus. The humidified and compressed batt of cotton continues down the lint slide to the press.

An object of this invention is to provide a maximum amount of moisture to the cotton batt that is safe for storage by forcing warm humid air through a constrained batt of cotton.

Another object of this invention is to humidify the cotton batt while alleviating the problem of cotton hairing on the lint slide grid and battery condensers.

Still another object of this invention is to provide the features described above with an apparatus which is cost effective and dependable.

Additional objects, features and advantages will be apparent in the written description which follows.

BEST MODE FOR CARRYING OUT THE INVENTION

Figure 1:
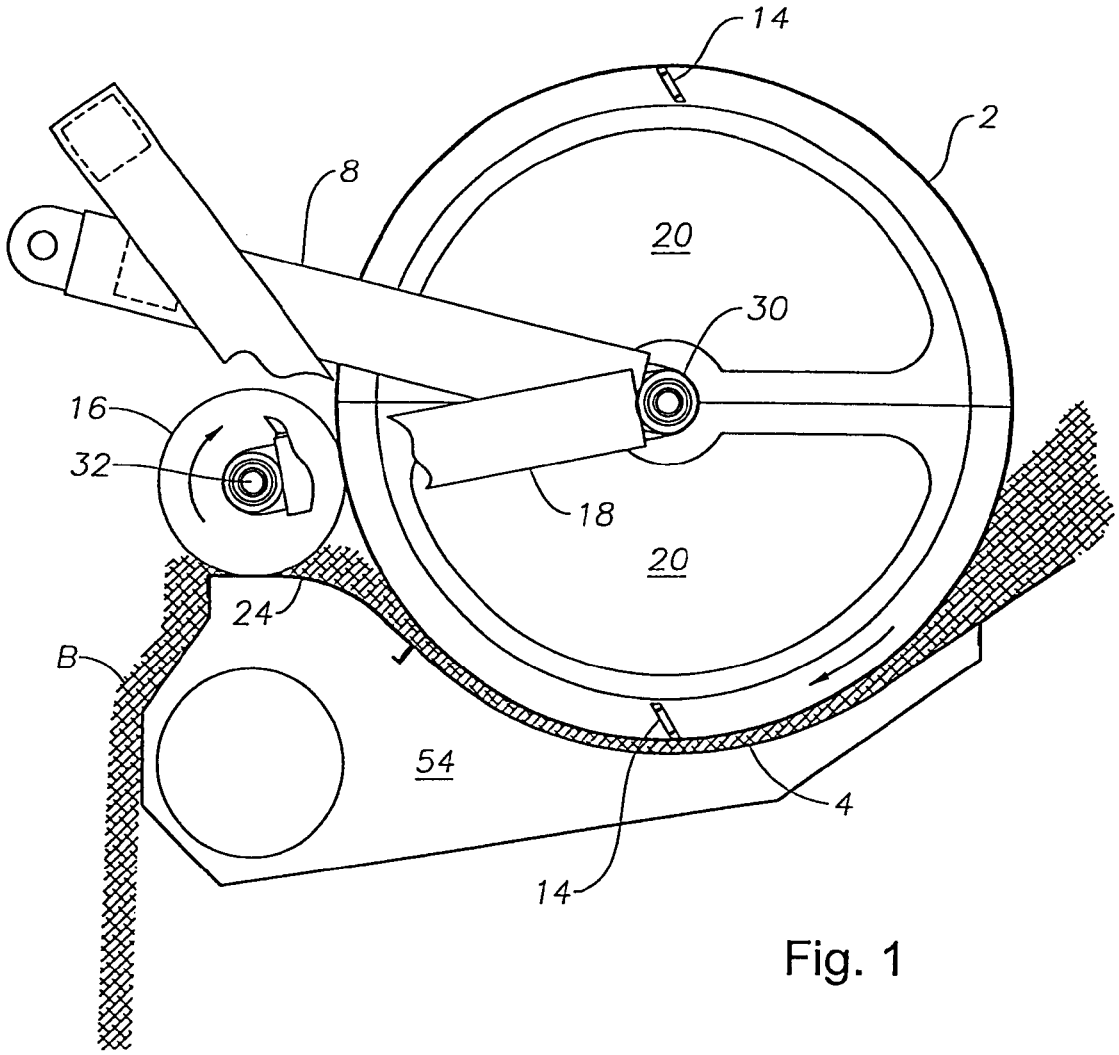
FIG. 1 is a side view of a moisture conditioning apparatus constructed in accordance with the invention, and having a rotatable cylinder, a stationary screen, a compression plate, a doffer/compression roller and link arms.

Referring to FIG. 1, a lint conditioning apparatus 144 includes a hollow cylinder 2 with a perforated sheet metal surface which rotates above a stationary perforated screen 4 about an axle 30. In the embodiment shown, cylinder 2 has a 43-inch diameter (1.09 meter) and screen 4 has a concave shape which faces upward. The die or rough side 3 of the surface of cylinder 2 is on its exterior to enhance gripping fibrous material being processed (FIG. 5). The punch or smooth side 5 of screen 4 is on the interior of cylinder 2. The surface of cylinder 2 and screen 4 are both formed from 16-gauge stainless steel which is punched with 3/16-inch diameter (4.76 mm) holes 3A staggered on ¼-inch (6.35 mm) centers resulting in a 51% open area through which air may pass. The rough side 3 of cylinder 2 is the side where the punch exited the sheet metal and the smooth side 5 is the side where the punch entered the sheet metal.

A continuous batt of cotton B is sandwiched between stationary screen 4 and cylinder 2. A doffer or compression roller 16 is mounted downstream of cylinder 2 on an axle 32 and held at a constant distance from axle 30 of cylinder 2 by link arms 18. Link arms 18 extend in parallel between axles 30 and 32. The outer surfaces of cylinder 2 and roller 16 are separated by a very small gap. Cylinder 2 is similarly supported by a second pair of link arms 8 which are at an acute angle relative to link arms 18.

Figure 2:
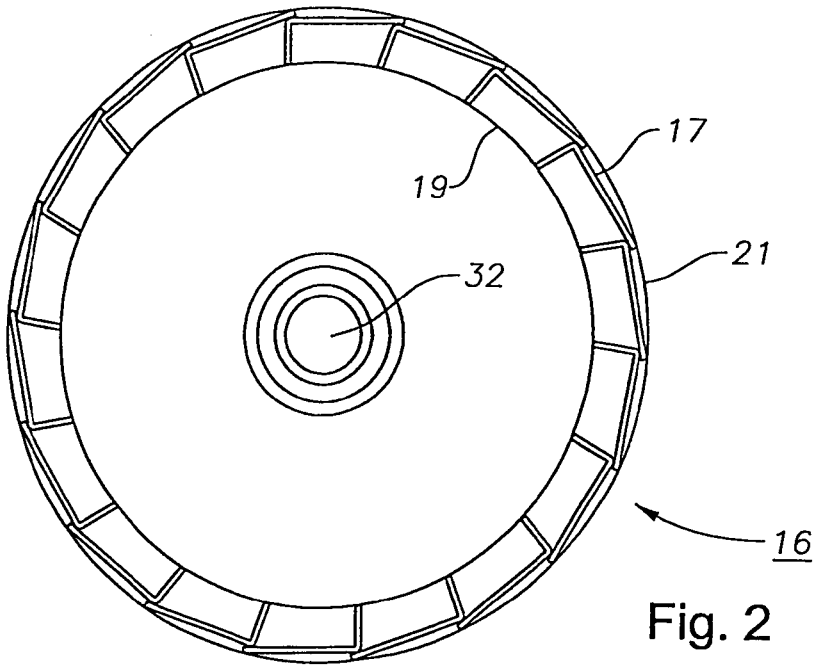
FIG. 2 is a sectional side view of the doffer/compression roller of FIG. 1.

As shown in FIG. 2, the outer surface of roller 16 is formed by a plurality of irregularities. In the embodiment shown, the irregularities are a series of 12-gauge longitudinal stainless steel, 90-degree members or angle pieces 17. Angles 17 are welded together around a cylindrical hub 19 and a 12-inch diameter (305 mm) roller end plate 21. Angles 17 form a generally cylindrical exterior with one leg of each angle 17 protruding almost tangentially from the surface of roller end plate 21. Angles 17 are disposed about and parallel to an axis of rotation of hub 19. Each angle 17 has a leading edge and a trailing edge. The leading edge of each angle 17 overlies and contacts the trailing edge of an adjacent angle 17. Angles 17 give roller 16 a strong and aggressive surface to doff cotton from cylinder 2 and press it against a solid compression plate 24 on its lower side. Compression plate 24 is formed from an unperforated 10-gauge stainless steel sheet and welded flush to screen 4 to form a continuous surface for batt B.

Referring to FIG. 1, two wipers 14 are fastened to the outer surface of each end face of cylinder 2. Wipers 14 are positioned 180 degrees apart and are inclined with respect to the radius of cylinder 2 in such a manner that they repel the entrance of pieces of batt B to the spaces between the cylinder end faces and the adjacent transverse sides of air evacuation hood 58 where they would otherwise accumulate and impede the rotation of cylinder 2. Wipers 14 are constructed from one-half inch square (322.6 mm square) steel. Four solid removable end panels 20 cover two openings in each end face of cylinder 2. End panels 20 seal the ends of cylinder 2 so that the proper air flow through its perforated surface is achieved. End panels 20 also allow access to the interior of cylinder 2 for cleaning and inspection when they are removed.

Figure 3:
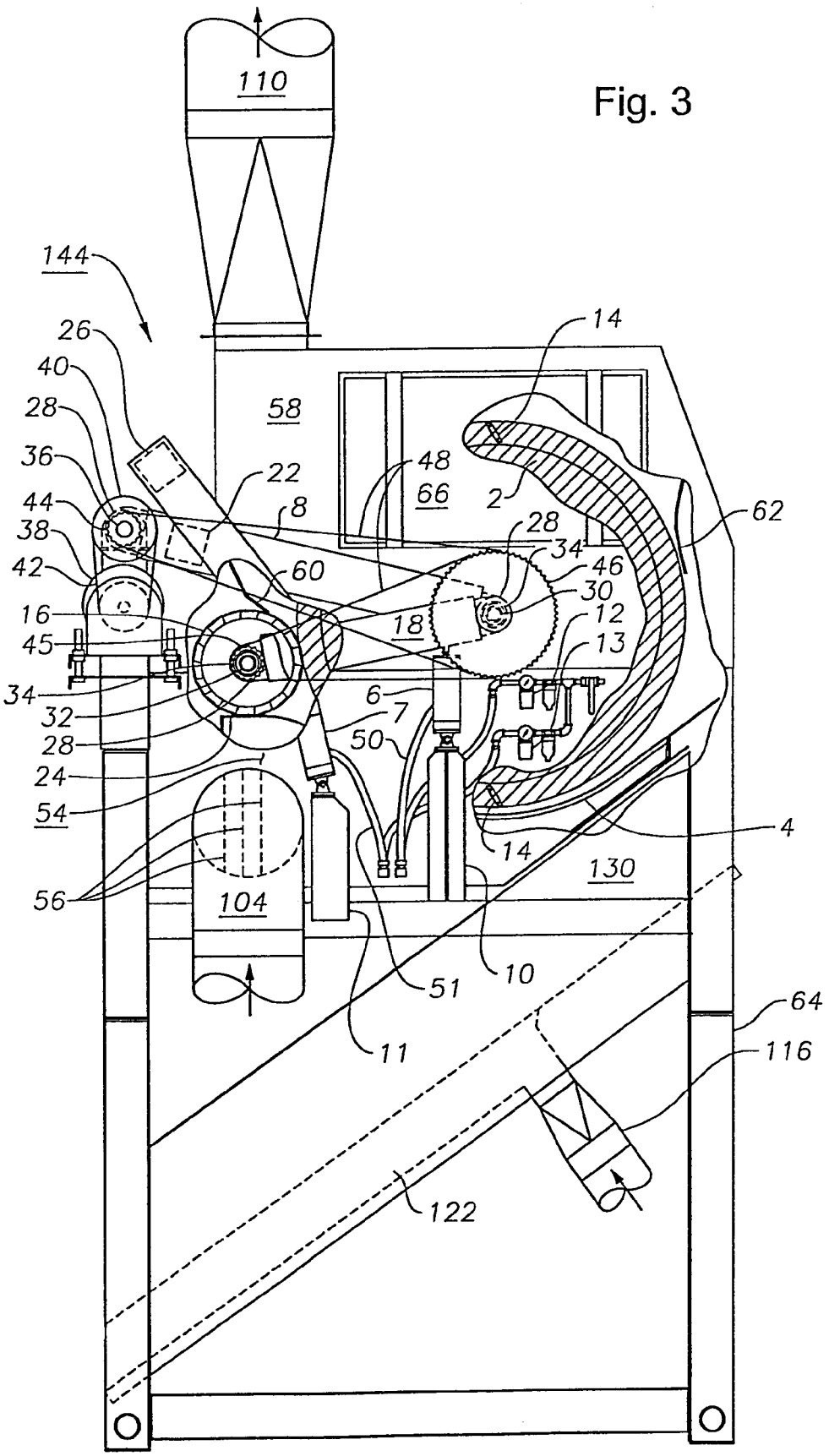
FIG. 3 is a partial sectional side view of the apparatus of FIG. 1 showing additional elements of the invention.

Referring now to FIG. 3, a pneumatic linear actuator 6 mounted on a pedestal 10 movably supports each link arm 8 near axle 30. Actuators 6 are positioned to act as a mechanical stop to maintain a minimum clearance of one inch between cylinder 2 and screen 4. Actuators 6 provide a partial, counterbalancing force to the large weight of the cylinder 2 assembly. In one embodiment, cylinder 2 weighs approximately 650 pounds (2.89 kN). Actuators 6 also limit the force which cylinder 2 exerts on batt B. An air pressure regulator 12 supplies pressurized air to actuators 6 through air hoses 50. In the preferred embodiment, actuators 6 have a two inch diameter (50.8 mm) bore which operate at approximately 45 psi (2.15 kPa). A cross brace 22 rigidly connects link arms 8 together to maintain them in the same rotational plane to keep the outer surface of cylinder 2 parallel to screen 4 across its entire width.

A second pair of pneumatic linear actuators 7 extend between link arms 18 and cylinder pedestals 11. Actuators 7 are very similar to actuators 6 and provide a minimum clearance of one inch (25.4 mm) between the surface of roller 16 and compression plate 24. Pressurized air regulated by air pressure regulator 13 provides air to actuators 7 through air hose 51. Actuators 7 partially counterbalance the weight of and control the force which roller 16 exerts on batt B flowing between roller 16 and compression plate 24. Cross brace 26 rigidly connects link arms 18 together keeping the link arms rotating in the same plane, thus roller 16 remains in a position parallel to compression plate 24 and to the axis of cylinder 2.

Cylinder 2 and roller 16 rotate on axles 30 and 32, respectively, in bearings 28 mounted on each end of link arms 8 and 18. As shown in FIG. 3, axles 30 and 32 are clamped to cylinder 2 and roller 16, respectively, with keyless bushings 34. The opposite ends of link arms 8 pivot on bearings 28 about a jack shaft 36. Cylinder 2 circumscribes an arcuate path as it pivots about jack shaft 36. Support structure 64 provides framework for the assembly and provides a structure to facilitate installing the apparatus in the gin.

Regarding the drive train for the apparatus, the output shaft of a five horsepower (3.73 kW) motor gear reducer assembly 38 is connected to jack shaft 36 with cogged belt 42 on cogged belt sheaves 40. The jack shaft 36 is connected to cylinder axle 30 with a No. 60 size roller chain 48 passing around a 16-tooth sprocket 44 and a 60-tooth sprocket 46. Roller 16 is driven off cylinder axle 30 with roller chain 48 passing around another 60-tooth sprocket 46 and 16-tooth sprocket 45. This selection for sprockets results in a five percent increase in the surface speed of roller 16 relative to cylinder 2. This surface speed increase provides a drafting action of batt B off cylinder 2 by roller 16.

Referring to FIGS. 1 and 3, warm humid air enters the air plenum 54 under the stationary perforated screen 4. The air is distributed evenly under the stationary screen 4 by a set of air turning vanes 56. After the air passes through batt B and cylinder 2, it is captured with an air evacuation hood 58. A larger volume of air is evacuated from hood 58 than is supplied from plenum 54 so that a negative pressure is created in apparatus 144. As a result, none of the warm humid air escapes to condense on lint separator or battery condenser 124. Air seals 60 and 62 rub against roller 16 and cylinder 2, respectively, to minimize infiltration of ambient air into apparatus 144. Hood access panels 66 located on each transverse side of air evacuation hood 58 are removable, allowing access to air evacuation hood 58 for cleaning and inspection.

Figure 4:
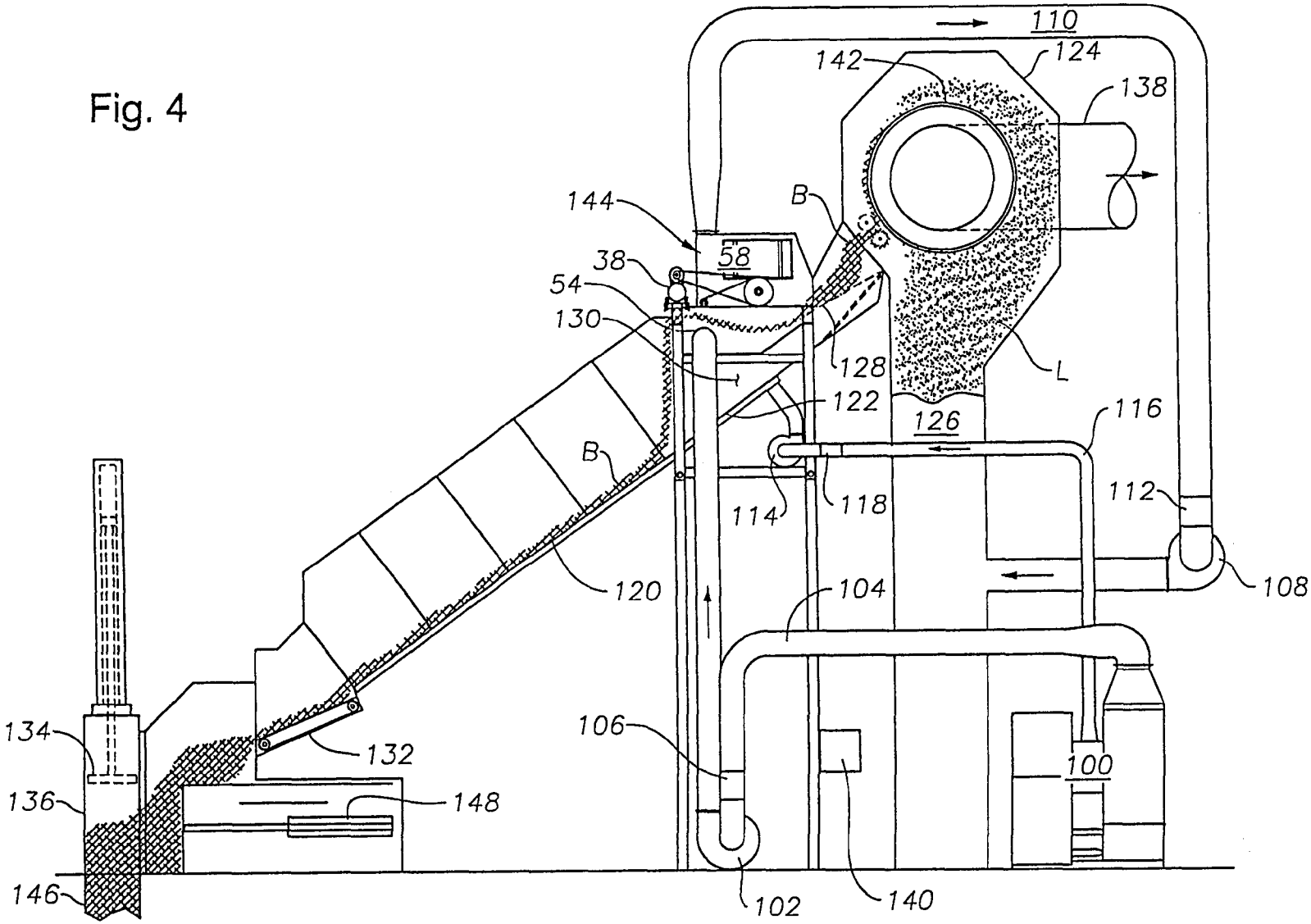
FIG. 4 is a schematic side view of the apparatus of FIG. 1 installed in a conventional cotton ginning plant with associated equipment.

Referring now to FIG. 4, lint cotton L coming from lint cleaning machines (not shown) is directed to battery condenser 124 in an air stream flowing through a lint flue riser 126. Battery condenser screen 142 separates lint L out of the air stream and creates cotton batt B. The air stream continues out of condenser 124 in pipe 138. Batt B is a blanket of cotton that flows out of battery condenser 124 and slides down an inclined surface (usually 35 to 40 degrees) called the feed ramp 128. The feed ramp 128 directs batt B into the lint conditioner apparatus 144. The lint conditioner apparatus 144 may be bypassed by pivoting feed ramp 128 about its upper end to angle its surface downward. Moving ramp 128 to the lower position directs batt B beneath lint conditioner apparatus 144 to a section of bypass slide 130 which connects with the lower lint slide 120. In the upper position shown by dotted lines, the cotton batt moves through lint conditioning apparatus 144 before being deposited on lint slide 120.

An adjustable frequency drive package 140 controls the surface speed of cylinder 2 in relation to the surface speed of the battery condenser screen 142. It is desirable for cylinder 2 to rotate five to ten percent faster than the battery condenser screen 142 in order to draft batt B into the lint conditioning apparatus 144. If cylinder 2 rotates at an equal or lesser speed than screen 142, batt B will bunch up before reaching cylinder 2, thereby creating the possibility of chokage. If cylinder 2 rotates in excess of ten percent faster than screen 142 batt B will be pulled apart inside lint conditioning apparatus 144. Pulling batt B apart diminishes the humidification performance of the apparatus as humid air escapes through the breaks in batt B constrained and flowing in the apparatus. The adjustable frequency drive package 140 adjusts the frequency of the three-phase alternating current electrical power supplied to the motor gear reducer assembly 38 to obtain the desired surface speed.

The air handling systems are also depicted in FIG. 4. A fan 102 pulls air through the air humidifying unit 100. The air humidifying unit 100 heats the stream of air to a sufficient temperature to evaporate water into the air stream, thus raising the humidity level of the air. The warm humid air is directed to the fan and on to lint conditioner apparatus 144 through pipe 104. An adjustable metering valve 106 regulates the volume of air to about 2,200 cubic feet (62.3 cubic meters) per minute of standard air.

Another fan 108 evacuates the used humid air out of the lint conditioner hood 58. Pipe 110 directs the air from hood 58 to fan 108 and typically to the lint flue riser 126 for discharge. A small amount of lint L is pulled from the apparatus, so discharging the used humid air to lint flue riser 126 eliminates the need to install expensive lint removal devices to prevent air pollution if the discharge was to ambient air. An adjustable metering valve 112 regulates the volume of air to about 4,000 cubic feet (113.3 cubic meters) per minute of standard air.

A small fan 114 pulls about 800 cubic feet per minute of standard air from a heated dry air port on the air humidifying unit 100, or other appropriate hot dry air source. The heated dry air travels through pipe 116 to dry hot air plenum 122 under the lint slide 120 to warm its surfaces. An adjustable metering valve 118 regulates the volume of hot dry air. Keeping all surfaces warm eliminates moisture condensation and sticking of batt B to cold surfaces.

Lint slide 120 directs the cotton to the cotton charger 132. The cotton charger 132 and press box pusher 148 fill the cotton into the press box 146. A tramper 134 compacts the cotton down in press box 146. The cotton is pressed into dense bales for transportation and storage with the bale press 136.

The invention has several advantages. The lint conditioning apparatus humidifies the batt more effectively than prior art designs by forcing warm moist air directly through the batt instead of merely exposing the batt to the warm moist air. It provides a maximum amount of moisture to the cotton batt that is safe for storage by forcing warm humid air through a constrained batt of cotton. The flow of air is constrained to the batt so that the air cannot escape around it. The batt is also compressed during the operation which reduces strain on the baling components.

While the invention has been shown or described in only some of its forms, it should be apparent to those skilled in the art that it is not so limited, but is susceptible to various changes without departing from the scope of the invention. For example, the cotton may be directed over the top of cylinder 2 with the stationary perforated screen 4 located above cylinder 2. It is also possible to use a plurality of cylinders 2 over which batt B passes sequentially. Each cylinder 2 would be doffed by its successor, and the last cylinder 2 would be doffed by roller 16. It is also possible to fix the positions of cylinder 2 and roller 16 and to control the force that screen 4 and compression plate 24 exert on batt B as it passes through the apparatus. It should also be apparent that the apparatus can be used to humidify wool, mohair and man-made fibers.

It is helpful to define the terminology used in regards to a lint condenser, a battery condenser and a lint separator. A lint condenser is a device that separates airborne fiber from an air stream and condenses the fiber into a batt of lint upon exiting the device. A battery condenser is the same as a lint condenser but is used in a cotton ginnery for receiving airborne lint cotton from a battery of cotton gin stands or lint cleaners. A lint separator is the same as a lint condenser except the term lint separator is used in a certain segment of the fibrous material processing industry.

We claim:

1. An apparatus for processing fibrous material, comprising:

a rotatable hollow first cylinder having a cylindrical sheet metal surface which has a plurality of punched perforations, defining a rough side where a punch has exited and a smooth side where the punch has entered; wherein the rough side of the surface of the first cylinder is located on the exterior of the first cylinder to enhance gripping fibrous material being processed; and a fan connected by a duct to an interior of the first cylinder for maintaining an interior of the first cylinder at less than ambient pressure to draw incoming fibrous material more tightly against the rough side of the cylindrical surface of the first cylinder.

2. The apparatus of claim 1, further comprising a rotatable second cylinder having a generally cylindrical surface which has an exterior side which has a plurality of irregularities, the second cylinder being located downstream of and spaced apart from the first cylinder by a minimal distance such that the second cylinder doffs said first cylinder.

3. The apparatus of claim 2 wherein the cylindrical surface of the second cylinder comprises a plurality of longitudinal members disposed about and parallel to an axis of rotation, each of the members having a leading edge and a trailing edge, the leading edge of each member overlying and contacting the trailing edge of an adjacent one of the members.

4. A humidifying apparatus for a fibrous material processor having a lint separator for creating a continuous batt of the fibrous material, the humidifying apparatus comprising:

a cylindrical drum having a drum screen with a plurality of openings, the drum being rotatable about a central axis and adapted to be located downstream from the lint separator;

a stationary screen adapted to be located downstream from the lint separator and adjacent to a portion of the screen of the drum, the stationary screen having a plurality of openings and being spaced apart from the drum by a separating amount; and an air plenum mounted to the stationary screen for supplying a continuous stream of hot humidified air through the openings of the stationary screen, the batt and the openings of the drum for humidifying the batt as it travels through the separating amount.

5. The humidifying apparatus of claim 4, further comprising:

a compression plate located downstream from and adjacent to the stationary screen; and a roller located adjacent to the drum and the compression plate for doffing the batt from the drum and compressing the batt between the roller and the compression plate.

6. The humidifying apparatus of claim 5, further comprising:

an axle for rotationally supporting the roller, the axle being positioned to provide a minimum separation between the roller and the compression plate and being movable toward and away from the compression plate to increase and decrease a separation therebetween; and wherein the axle and the roller are urged toward the compression plate.

7. The humidifying apparatus of claim 6 wherein the compression plate is located below the roller and wherein the weight of the roller urges the roller toward the compression plate.

8. The humidifying apparatus of claim 7, further comprising an adjustable-force actuator connected to the axle for applying an upward counter force to the weight of the roller, to reduce a force imposed on the batt by the weight of the roller as the batt passes between the roller and the compression plate.

9. The apparatus of claim 5 wherein the roller comprises a plurality of longitudinal members disposed about and parallel to an axis of rotation, each of the members having a leading edge and a trailing edge, the leading edge of each member overlying and contacting the trailing edge of an adjacent one of the members.

10. The humidifying apparatus of claim 4, further comprising:

an axle for rotationally supporting the drum, the axle being positioned to provide a minimum separation between the drum and the stationary screen and being movable toward and away from the stationary screen to increase and decrease the separating amount; and wherein the axle and the drum are urged toward the stationary screen.

11. The humidifying apparatus of claim 10 wherein the stationary screen is located below the drum and wherein the weight of the drum urges the drum toward the stationary screen.

12. The humidifying apparatus of claim 11, further comprising an adjustable-force actuator connected to the axle for applying an upward counter force to the weight of the drum, to reduce a force imposed on the batt by the weight of the drum as the batt passes through the separating amount.

13. The humidifying apparatus of claim 4 wherein the openings in the drum screen punched perforations which define a rough side where a punch has exited and a smooth side where a punch has entered, the rough side of the screen of the drum being on the exterior of the drum.

14. The humidifying apparatus of claim 4, further comprising end panels removably mounted to circular ends of the drum, to prevent passage of air through the ends of the drum.

15. The humidifying apparatus of claim 4, further comprising:

a housing in which the drum is located; and an evacuation conduit leading from the housing and connected to a negative pressure source, the pressure within the drum adapted to be less than ambient pressure for drawing the batt of the fiber against the screen of the drum.

16. In a cotton gin having a lint condenser for creating a batt of cotton from lint cotton, an improved lint conditioning apparatus, comprising:

a feed ramp located adjacent to the lint separator for receiving that batt exiting the lint separator;

a cylindrical drum having a drum screen with a plurality of openings, the drum being rotatable about a central axis and located at a downstream end of the feed ramp;

a stationary screen located at the downstream end of the feed ramp and adjacent to a portion of the drum, the stationary screen having a plurality of openings and being spaced apart from the drum by a separating amount;

an air plenum mounted to the stationary screen for supplying a continuous stream of hot humidified air through the openings of the stationary screen, the batt and the openings of the drum as the batt travels through the separating amount;

a compression plate located downstream from and adjacent to the stationary screen; and a roller located adjacent to the drum and the compression plate for doffing the batt from the drum and compressing the batt between the roller and the compression plate.

17. A method for humidifying a fibrous material in a processor having a lint separator for creating a continuous batt of the fibrous material, comprising:

(a) feeding the batt from the lint separator to a separation between a cylindrical rotating drum having a perforated drum screen and a perforated stationary screen adjacent to a portion of the drum screen;

(b) forcing a continuous stream of hot humidified air through the stationary screen, the batt and the screen of the drum for humidifying the batt as it travels through the separation; and (c) doffing the batt off of the screen of the drum with a roller.

18. The method of claim 17, further comprising compressing the batt between the roller and a compression plate.

19. The method of claim 17, further comprising rotationally supporting the drum with an axle which is movable toward and away from the stationary screen, and maintaining a minimum separation between the drum and the stationary screen.

20. The method of claim 17, further comprising the step of pulling a limited amount of ambient air through the drum at a location where the batt makes first contact with the drum in order to help grip the batt onto the drum.

* * * * *